US006994232B2

(12) United States Patent
Lawson et al.

(10) Patent No.: US 6,994,232 B2
(45) Date of Patent: Feb. 7, 2006

(54) SELF-VENTING INK CARTRIDGE

(75) Inventors: Rebecca Lawson, Florence, SC (US); James Lowry, Florence, SC (US); Wylie H. Hodge, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 71 days.

(21) Appl. No.: 10/495,067

(22) PCT Filed: Oct. 21, 2002

(86) PCT No.: PCT/US02/33552

§ 371 (c)(1),
(2), (4) Date: May 4, 2004

(87) PCT Pub. No.: WO03/040001

PCT Pub. Date: May 15, 2003

(65) Prior Publication Data

US 2004/0238575 A1 Dec. 2, 2004

(51) Int. Cl.
*B67D 5/42* (2006.01)

(52) U.S. Cl. ..... 222/386; 222/387

(58) Field of Classification Search ..... 222/386, 222/387

See application file for complete search history.

(56) References Cited

U.S. PATENT DOCUMENTS 4,854,485 A * 8/1989 Collins ..... 222/386
5,878,922 A * 3/1999 Boring ..... 222/387

* cited by examiner

*Primary Examiner*—Philippe Derakshani
(74) *Attorney, Agent, or Firm*—Clausen Miller, PC

(57) ABSTRACT

A self-venting cartridge (10) for dispensing an extrudable fluid such as ink. The cartridge (10) comprises a cylindrical body (12) for holding the fluid and a plunger (18) for forcing the fluid through a nozzle. The cylindrical body (12) is formed of a wound material and lined internally with a liner material that overlaps itself to form a raised area (34) that is slightly thicker than the surrounding area. The plunger (18) comprises a slightly convex surface (36) and a sidewall (40) that forms a snug fit with the cylindrical body (40). The plunger sidewall (40) and raised area (34) define a channel (A) through which air is automatically vented when the plunger (18) is inserted into the fluid-filled cartridge (10).

6 Claims, 2 Drawing Sheets

SELF-VENTING INK CARTRIDGE

BACKGROUND

1. Field of the Invention

This patent relates to ink dispensing cartridges for automated dispensing systems, such as those used for lithographic printing presses. More specifically, this patent relates to an improved ink cartridge that automatically vents air without the aid of a venting strip when the plunger is inserted into the cartridge body.

2. Description of the Related Art

Typical lithographic ink cartridges, such as that disclosed in U.S. Pat. No. 6,192,797, incorporated herein by reference, comprise a hollow cylindrical body, a plunger and a dispensing fitment. The cylindrical body holds a supply of extrudable ink or other fluid and has a dispensing end and a plunger end. The dispensing end is sealed with the dispensing fitment, which typically includes a nozzle for directing the flow of the ink. The plunger end is sealed by the plunger, which moves within the cylindrical body to extrude the ink when the plunger is forced toward the dispensing end by pneumatic pressure or other means.

Lithographic ink cartridges typically are filled by placing the cartridge, with the dispensing fitment attached, underneath an ink flow. The cartridges typically are filled to a predetermined weight, and then the plunger is inserted into the plunger end of the cartridge.

During the ink filling process, air can get trapped inside the cartridge chamber between the plunger and the ink when the plunger is inserted into the cartridge and pressed against the ink. Air entrapment can cause the ink to "skin over", creating a skin of partly oxidized ink on top of the ink. This skin can plug the nozzle in the dispensing fitment, or cause printing "hickies", i.e., areas on a sheet without ink coverage.

Typically, the air is vented between the plunger and the cartridge wall by using a vent strip. The vent strip creates a channel through which the air can escape as the plunger is inserted. When the plunger is fully inserted, the vent strip is removed.

Using a vent strip is inconvenient and requires securing the vent strip to something to keep it in place while the plunger is being inserted. The vent strip must be removed once the plunger is fully inserted, which can be difficult to do, and can cause damage to the plunger, through plastic deformation, and to the cartridge wall, by ripping, tearing or scuffing the liner.

When a conventional ink cartridge is depressurized, there can be tendency for the plunger to move back up the cartridge as air pressure under the plunger equilibrates with the pressure above the plunger. By eliminating trapped air under the plunger, the present invention eliminates the problem of plunger "back up".

Thus the primary object of the present invention is to provide an ink cartridge that automatically vents the air when the plunger is inserted, without the need for a vent strip.

Another object of the invention is to provide an ink cartridge that prevents the plunger from backing up when the cartridge is depressurized.

Still another object of the invention is to provide an ink cartridge that prevents air from reentering the cartridge during or after use.

Further and additional objects will appear from the description, accompanying drawings, and appended claims.

SUMMARY OF THE INVENTION

The present invention is a cartridge for dispensing an extrudable fluid, wherein the cartridge is self-venting. The cartridge comprises a cylindrical body for holding fluid such as ink, a dispensing fitment, and a plunger. The cylindrical body has opposing open ends and preferably is formed of a wound material and lined internally with a liner material. The liner material overlaps itself to form a raised area that is slightly thicker than the surrounding area. The plunger comprises a slightly convex ink-contacting surface and a sidewall extending upward from the periphery of the convex surface. The sidewall comprises three sections: a bottom section nearest the convex surface, a middle section adjacent the bottom section, and an upper section. The bottom section has an outer diameter less than the inner diameter of the cylindrical body. The middle section has an outer diameter greater than the outer diameter of the bottom section but less than the inner diameter of the cylindrical body. The upper section forms a snug fit with the cylindrical body. In a key aspect of the invention, the plunger and raised area define a channel through which air is automatically vented when the plunger is inserted into the fluid-filled cartridge.

THE DRAWINGS

DETAILED DESCRIPTION OF THE INVENTION

Although the present invention can be used to hold and dispense many different types of extrudable fluids, including but not limited to inks and paints, the preferred embodiment will be described with respect to a cartridge for holding ink of the kind used in automatic lithographic printing.

Figure 1:
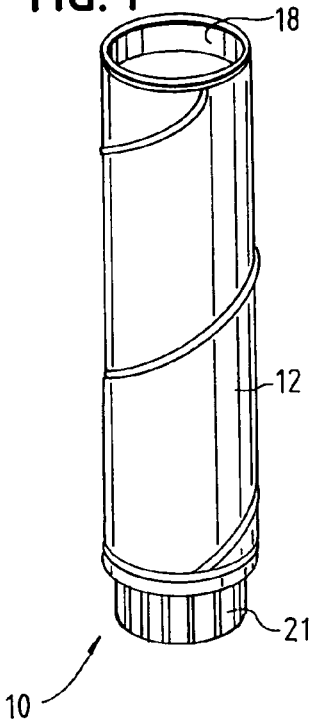
FIG. 1 is a perspective view of an ink cartridge according to the present invention.
Figure 2:
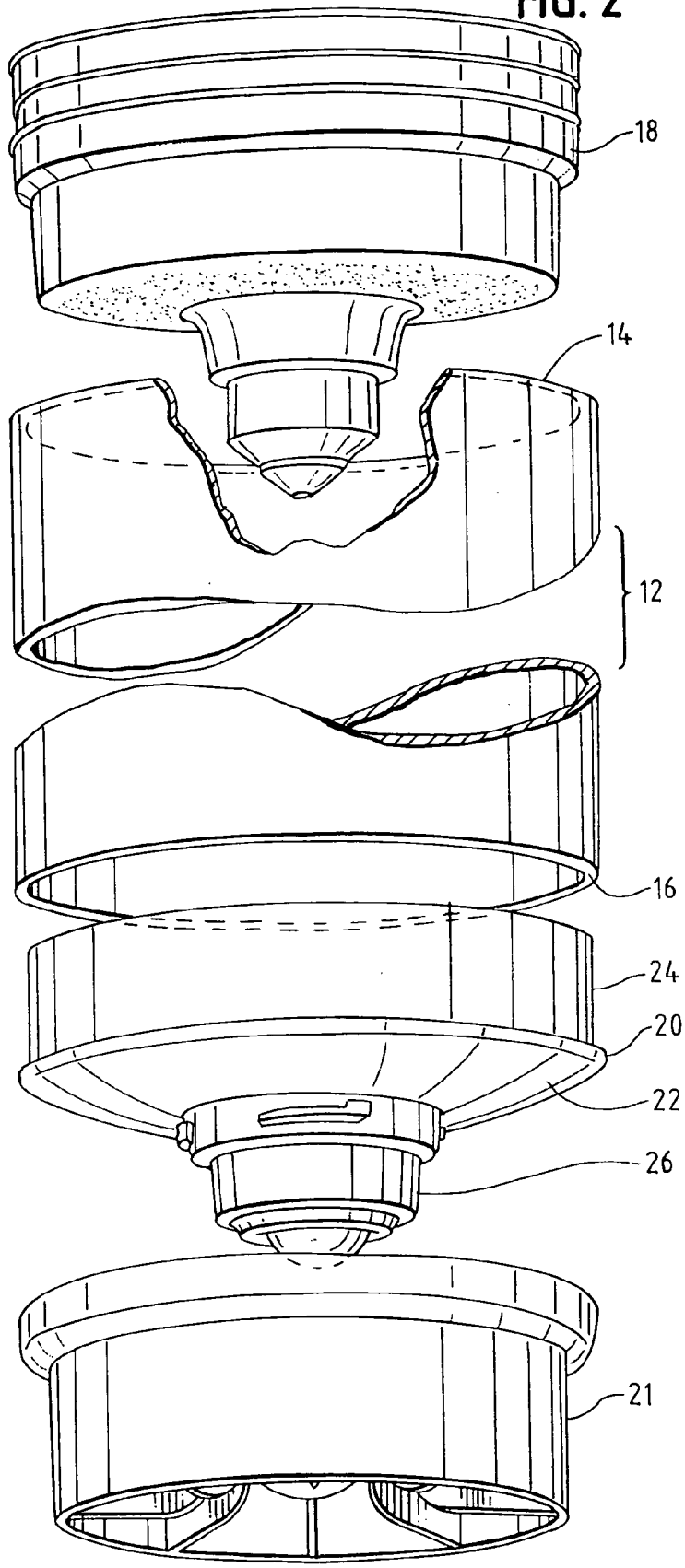
FIG. 2 is an enlarged exploded view of the ink cartridge of FIG. 1, showing, from top to bottom, the cartridge plunger, body, dispensing fitment and shipping cap.

Turning to the drawings, there is shown in FIGS. 1 and 2 an ink cartridge 10 according to the present invention. The ink cartridge 10 comprises a hollow cylindrical body 12 having a plunger (top) end 14 and a dispensing (bottom) end 16, a plunger 18 inserted into the plunger end 14 for sliding engagement with the inside wall of the cartridge body 12, a dispensing fitment 20 mounted in sealing engagement with the dispensing end 16 of the cartridge body 12, and an optional shipping cap 21 removably secured to the dispensing fitment 20. Typically, the dispensing fitment 20 is glued or heat-sealed to the cartridge body 12. The shipping cap 21 is the subject of pending U.S. provisional application 60/316,759 and protects the dispensing fitment 20, prevents ink from leaking out of the cartridge 10 by putting pressure on the dispensing fitment 20, and enables the cartridge 10 to be stood with the dispensing end down.

The dispensing fitment 20 is the subject of pending U.S. patent application Ser. No. 09/944,700 and generally comprises a covering portion 22 and an annular sidewall 24 formed around the periphery of the covering portion 22 and extending upward (up being defined as the direction toward the plunger end 14). A nozzle 26 for controlling the flow of ink is mounted to the covering portion 22 over a centrally disposed aperture.

Figure 3:
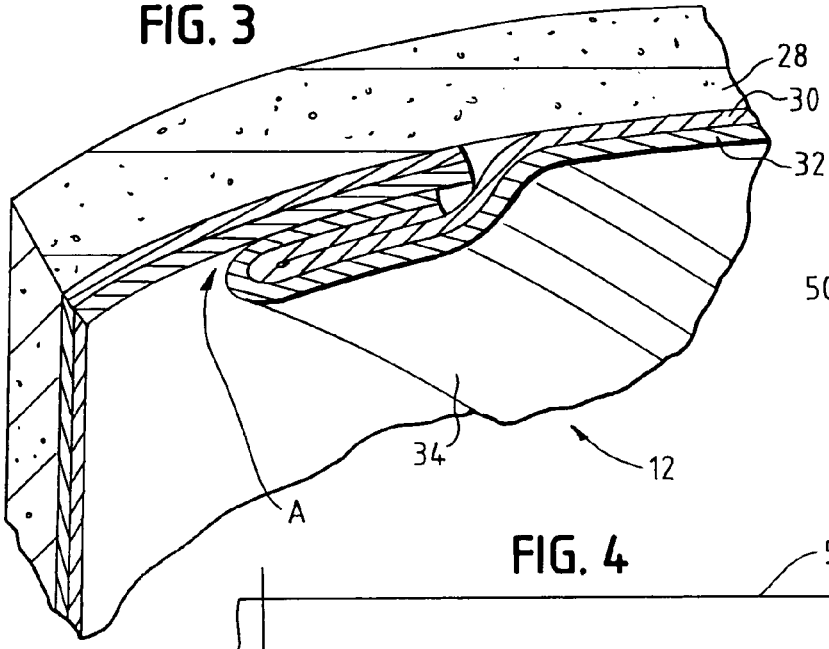
FIG. 3 is a detailed perspective view of the ink cartridge body of FIG. 2.

The cartridge body 12 typically is made of wound paperboard 28 lined internally with a layer of paper 30 pre-adhered to a barrier layer 32, such as foil and/or a polymeric material. The paper/poly liner 30, 32 may form a straight lap seam, with one edge overlapping the other, or an anaconda fold such as that shown in FIG. 3. In an anaconda fold, the paper/poly liner 30, 32 is folded back on itself so that the barrier layer 32 is adhered to the underlying barrier layer. In either case, and especially in the case of the anaconda fold, the overlapping liner creates a raised area 34 on the inside wall of the cartridge body 12 that is slightly thicker than the surrounding area. The area immediately adjacent the raised area is designated area "A" in FIG. 3. Area A, as will be explained below, functions as a channel through which air can escape when the plunger 18 is inserted into the cartridge body 12.

Figure 4:
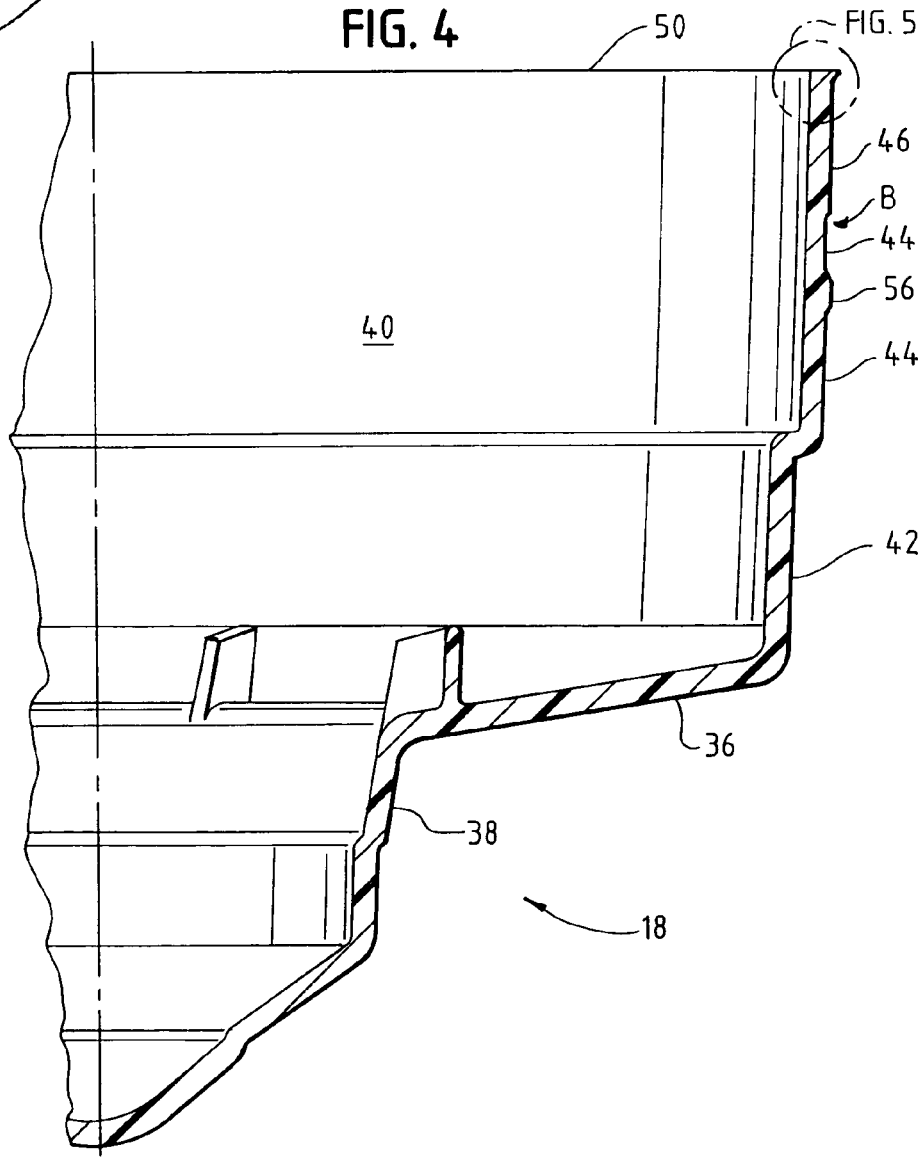
FIG. 4 is a cross-sectional view of the plunger of FIG. 2.

As shown in FIG. 4, the plunger 18 comprises a slightly convex ink-contacting surface 36 (although the surface may be flat), a downwardly extending hub portion 38 and a three-tiered sidewall 40 extending upward from the outer periphery of the convex surface 36. The hub portion 38 is shaped to nest within the dispensing fitment 20 to minimize the volume of ink left in the cartridge chamber when the plunger 18 is forced against the dispensing fitment 20.

The plunger sidewall 40 comprises three tiers, or sections, 42, 44 and 46, of increasing outer diameter from bottom up. The outer diameter of the bottom section 42 is less than the inside diameter of the cartridge wall 12. As the plunger is forced against the ink, air and ink travel upward through the narrow annular area defined by the bottom section 42 and the cartridge wall 12.

The diameter of the middle section 44 is greater than that of the bottom section 42 but still slightly less than that of the cartridge wall 12. An annular sealing band 56 extends outward from the middle section 44. This band 56 contacts the cartridge body wall 12, but air and ink can still migrate above it when the plunger is pressed against the ink surface. Preferably, the band is about 0.050 inches wide and extends outward about 0.005 inches from the surface of the middle section 44. The band 56, the portion of the middle section 44 above the band 56, the upper section 46 and the cartridge wall 12 define an annular area B. As will be explained, ink gets trapped in area B and forms a seal.

The diameter of the upper section 46 is such that it forms a snug fit with the inside wall of the cartridge body 12. Very little ink migrates between the upper section 46 and the cartridge wall 12 during use, except in the vicinity of channel A.

Figure 5:
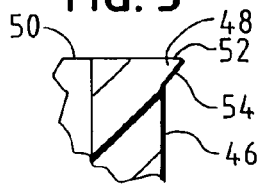
FIG. 5 is a close up view of part of the plunger of FIG. 4.

As best shown in FIG. 5, a flange 48 extends radially outward from the upper edge 50 of the plunger. The flange 48 has a flat upper surface 52 even with the plane of the upper edge 50 of the plunger 18 and an angled lower surface 54 that tapers inward toward the plunger sidewall 40 at an angle of about 45 degrees. When the plunger 18 is inserted into the cartridge, the flange 48 digs slightly into the cartridge sidewall 12 and wipes the sidewall 12 as the plunger 18 advances. In a preferred embodiment, the flange 48 digs into the sidewall 12 about 0.015 inches. The flange 48 is designed to function as a one-way valve, allowing air and fluid to exit up and out of the cartridge chamber but preventing air from reentering the cartridge when the cartridge is in use in a pressurized system.

The invention works in the following manner. The cartridge 10 typically is filled by the ink manufacturer by setting the cartridge 10 with the dispensing end 16 down underneath an ink flow. The dispensing fitment nozzle 26 is closed and may be kept closed by the shipping cap 21 pressing against it. The ink is poured or pushed into the plunger end 14 of the cartridge 10 until the ink reaches a predetermined weight or volume. The plunger 18 is placed in a plunger inserter device and is inserted into the plunger end 14 until the plunger 18 is flush against the surface of the ink. As the plunger 18 is inserted, the pressure inside the chamber may reach 20–40 psi or more, depending on the type of cartridge used. During this time the ink may be slightly compressed within the cartridge chamber.

As the plunger 18 is forced against the surface of the ink, any air trapped between the plunger 18 and the surface of the ink is forced outward toward the cartridge wall 12 because of the convex shape of the plunger 18. The convex surface 36 of the plunger 18 may be textured to aid the flow of air toward the cartridge wall, as taught in U.S. Pat. No. 6,419,351, incorporated herein by reference. The air and some of the ink are then forced upward between the plunger sidewall 40 and the cartridge wall 12 and past the band 56. The ink that becomes trapped above the band 56 in the annular area B helps maintain the seal between the plunger sidewall 40 and the cartridge body 12.

As the plunger 18 continues to press down on the ink, air is automatically vented through channel A near the cartridge seam 34 and past the flange 48. Ink rises up behind the air through channel A. The presence of ink in channel A prevents air from reentering the cartridge through the channel when the cartridge is in use. Due to the high surface tension and viscosity of the ink, the air pressure necessary to force the ink back down the channel A and into the cartridge is greater than the force necessary to move the plunger. Once the plunger is fully inserted, the plunger inserter is backed away.

In conventional ink cartridges, if air is trapped under the plunger, when the pressure on the back side of the plunger is reduced, either by backing away the inserter or by reducing the pneumatic pressure after a printing run, the air pressure under the plunger can cause the plunger to back up until the air pressure is equal on both sides of the plunger. By eliminating air entrapment under the plunger 18, the present invention eliminates the problem of plunger "back up". Plunger back up does not occur with cartridges made according to the present invention because all the air under the plunger 18 is removed when the plunger 18 is inserted into the cartridge body 12.

The plunger 18, dispensing fitment 20 and shipping cap 21 typically are made of plastic. There are two main types of ink cartridge bodies. One type is about twelve inches long and about 5 inches in diameter and is referred to as a composite can. The second type is about thirteen inches long and has an inside diameter of about 3 and ¾ inches. For the purposes of the invention however, the cartridge may be any suitable size and shape, depending on need and the dimensions of the cartridge carrier.

Other modifications and alternative embodiments of the invention are contemplated which do not depart from the scope of the invention as defined by the foregoing teachings and appended claims. It is intended that the claims cover all such modifications that fall within their scope.

We claim as our invention:

1. A cartridge (10) for dispensing an extrudable fluid, the cartridge (10) comprising:

a cylindrical body (12) for holding the fluid, the body (12) having opposing open ends (14, 16) and formed of a wound material and lined internally with a liner material, the liner material overlapping itself to form a raised area (34) that is slightly thicker than the surrounding area;

a dispensing fitment (20) for sealing one open end (16) of the cylindrical body (12); and a plunger (18) comprising a slightly convex surface (36) and a sidewall (40) extending upward from the periphery of the convex surface (36), the sidewall (40) comprising a bottom section (42) nearest the convex surface (36), a middle section (44) adjacent the bottom section (42), and an upper section (46), the bottom section (42) having an outer diameter less than the inner diameter of the cylindrical body (12), the middle section (44) having an outer diameter greater than the outer diameter of the bottom section (42) but less than the inner diameter of the cylindrical body (12), the upper section (46) forming a snug fit with the cylindrical body (12); and an air venting channel (A) adjacent the raised area (34) and defined by the plunger sidewall (40) and the cylindrical body (12).

2. The cartridge (10) of claim 1 wherein the middle section (44) further comprises an annular sealing band (56) extending outward from the middle section (44) and contacting the cylindrical body (12) when the plunger (18) is inserted into the body (12); the band (56), middle section (44), upper section (46) and cylindrical body (12) defining an annular area (B) in which fluid gets trapped when the plunger (18) is inserted into a fluid-filled cartridge (10) and pressed against the surface of the fluid.

3. The cartridge (10) of claim 1 wherein the plunger (18) further comprises an upper edge (50) defining a plane and the upper section (46) further comprises a flange (48) extending outward from the upper edge (50), the flange (48) allowing air and fluid to exit but not enter the cartridge (10).

4. The cartridge (10) of claim 3 wherein the flange (48) digs into the inside surface of the cylindrical body (12) when the plunger (18) is inserted.

5. The cartridge (10) of claim 3 wherein the flange (48) has a flat upper surface (52) even with the plane of the upper edge (50) of the plunger (18) and an angled lower surface (54) that tapers inward toward the plunger sidewall (40).

6. The cartridge (10) of claim 5 wherein the flange upper and lower surfaces (52, 54) define an angle of about 45 degrees.

* * * * *